US008719981B2

(12) United States Patent
Jaskot

(10) Patent No.: US 8,719,981 B2
(45) Date of Patent: May 13, 2014

(54) PILLOW WITH NECK SUPPORT

(76) Inventor: John Jaskot, Markham (CA)

( * ) Notice: Subject to any disclaimer, the term of this patent is extended or adjusted under 35 U.S.C. 154(b) by 42 days.

(21) Appl. No.: 13/455,666

(22) Filed: Apr. 25, 2012

(65) Prior Publication Data

US 2012/0272453 A1 Nov. 1, 2012

Related U.S. Application Data

(60) Provisional application No. 61/517,929, filed on Apr. 28, 2011.

(51) Int. Cl.
*A47C 20/00* (2006.01)

(52) U.S. Cl.
USPC ..... 5/644; 5/728; 5/640; 5/636; 5/639

(58) Field of Classification Search
USPC ..... 5/644, 640, 636, 639, 645, 490, 728
See application file for complete search history.

(56) References Cited

U.S. PATENT DOCUMENTS 4,365,371 A * 12/1982 Boussaroque ..... 5/728
4,847,931 A * 7/1989 Bard ..... 5/644
4,896,388 A * 1/1990 Bard ..... 5/644
5,632,051 A * 5/1997 Stanley et al. ..... 5/636
5,916,088 A * 6/1999 Gueli ..... 5/639
6,401,279 B1 * 6/2002 Vaughn ..... 5/644
6,918,146 B2 * 7/2005 England ..... 5/653
7,017,214 B2 * 3/2006 Bard ..... 5/644
7,832,034 B2 11/2010 Liu et al.
2003/0052035 A1 * 3/2003 Dickinson ..... 206/522
2006/0123551 A1 * 6/2006 Hsia ..... 5/706
2009/0144901 A1 * 6/2009 Zorger ..... 5/489
2009/0199342 A1 * 8/2009 Delfs ..... 5/645
2009/0205135 A1 * 8/2009 Asaka et al. ..... 5/639
2009/0211030 A1 * 8/2009 Norstrem ..... 5/640
2010/0028589 A1 * 2/2010 Van Houten et al. ..... 428/53
2011/0173754 A1 * 7/2011 Calder ..... 5/644
2012/0117733 A1 * 5/2012 Chen ..... 5/652.1

* cited by examiner

*Primary Examiner* — Robert G Santos
*Assistant Examiner* — Myles Throop
(74) *Attorney, Agent, or Firm* — Mary M. Lee

(57) ABSTRACT

A pillow having a bladder for containing fluid or gas and on top of which compressible fill is to float. The pillow includes an elongate neck support mat atop an upper surface of the bladder, under the compressible fill, and extending along the substantially the length of one side of the bladder. The elongate mat provides upwards neck support when a user's head displaces fluid or gas by applying a downwards force near the center portion of the bladder.

13 Claims, 6 Drawing Sheets

PILLOW WITH NECK SUPPORT

CROSS-REFERENCE TO RELATED APPLICATIONS

This application claims the benefit of U.S. provisional application No. 61/517,929, filed Apr. 28, 2011, and owned in common herewith.

FIELD

The present application generally relates to pillows and, specifically, to water or air pillows that feature neck support.

BACKGROUND

Many attempts have been made to improve the comfort and chiropractic characteristics of pillows. One such attempt was development of a water pillow, as exemplified by U.S. Pat. No. 4,896,388 to Bard. The water pillow features a bladder within the pillow intended to be filled with water that then deforms to shape to the head of the user.

U.S. Pat. No. 7,017,214 to Bard described a variation on the water pillow in which flow was restricted within the bladder through a series of heat seal islands.

One of the drawbacks of the water pillow is that it provides little or no neck support since the localized downward pressure of the user's neck simply displaces the water in the bladder at that location.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

In one aspect, the present application describes a pillow including a top surface and a bottom surface forming an envelope, the top and bottom surfaces having a long edge and two short edges; a bladder within the envelope and attached to the bottom surface, the bladder having an upper surface, the upper surface and top surface defining an open space for containing compressible fill inserted in the envelope to float on the bladder when the bladder contains a fluid or gas substance, and wherein the bladder has a long side corresponding to the long edge of the bottom surface; and an elongate neck support mat atop the upper surface of the bladder proximate the long side of the bladder and extending parallel with the long edge.

In yet a further aspect, the present application describes a pillow including compressible fill or a conventional pillow within the envelope.

Other aspects and features of the present application will be understood by those of ordinary skill in the art from a review of the following description of examples in conjunction with the accompanying figures.

Figure 1:
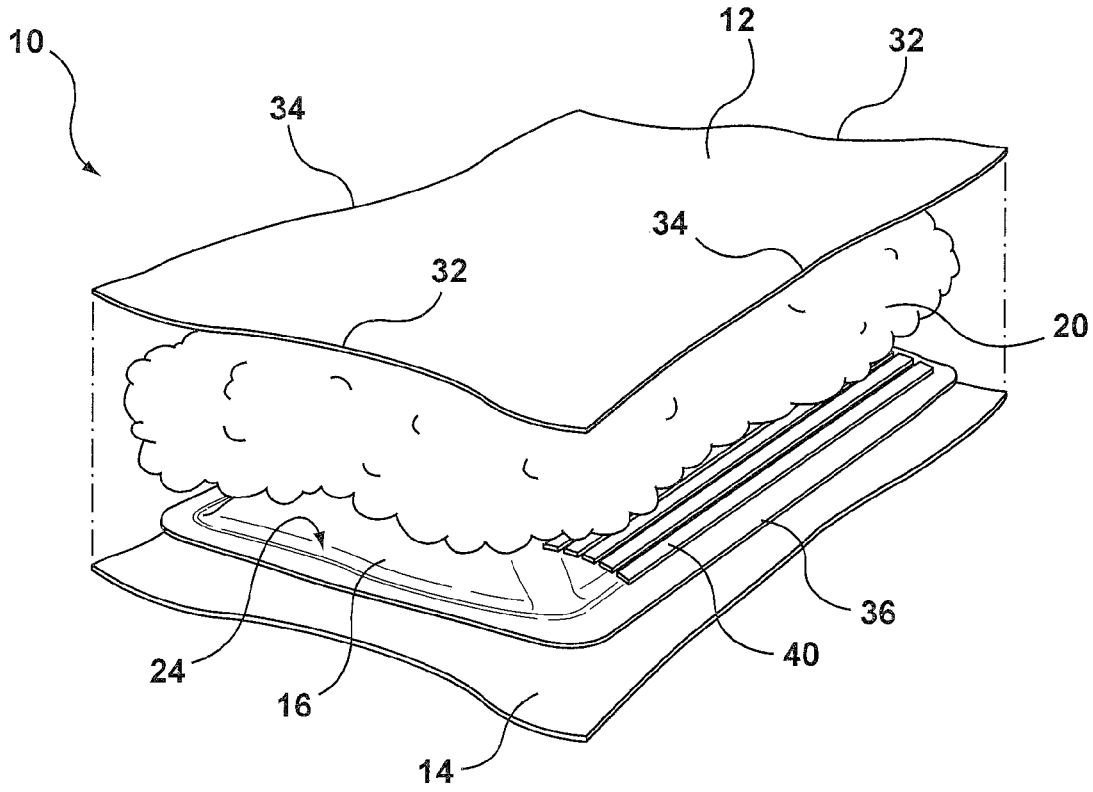
FIG. 1 shows an exploded perspective view of one example of a pillow.
Figure 2:
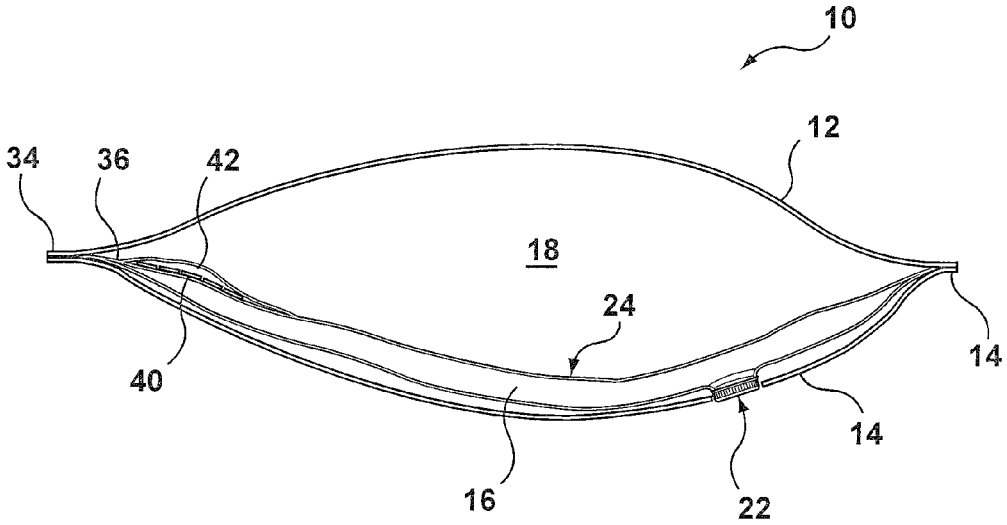
FIG. 2 shows a cross-sectional end view of one example pillow.

References first made to FIG. 1, which shows a perspective exploded view of one example embodiment of a pillow 10. Reference is also made to FIG. 2, which shows a cross sectional side view of the example pillow 10.

The pillow 10 includes a top surface 12 and bottom surface 14. In this example the top surface 12 and bottom surface 14 are generally rectangular in shape and each have two short edges 32 and two long edges 34. The top surface 12 and bottom surface 14 are attached along at least three of their respective edges to form an envelope. In one example, the top surface 12 and bottom surface 14 are attached together by stitching or other fabric attachment mechanisms along the respective long edges 34 and one of the short edges 32.

The pillow 10 further includes a bladder 16 within the envelope and attached to the bottom surface 14. The bladder 16 may be substantially similar in size or slightly smaller than the bottom surface 14. The bladder 16 is intended to contain a fluid or gas, such as water or air. Accordingly, the bladder 16 includes a spout 22 for filling and draining the bladder 16. In some cases, the spout 22 is accessible through the bottom surface 14. The spout 22 includes a suitable closure mechanism for ensuring that the fluid or gas within the bladder 16 does not leak when the pillow 10 is in use. The bladder 16 may be formed from a water impermeable material, like rubber or plastic, that holds the fluid or gas, and which is surrounded by an insulating layer. The insulating layer may be formed from a variety of materials having insulting and/or cushioning properties. The insulating layer may be created using multiple layered materials in some cases. In one example, the insulating layer includes a foil or other thermally-reflective material layer on its inner surface, and a cloth or other fabric layer on its outer surface. Other constructions of an insulating layer will be appreciated by those ordinarily skilled in the art having regard to the description herein.

The bladder 16 is secured to the bottom surface 14 of the pillow 10. In some embodiments, the bladder 16 may by attached by fasteners or by adhesives. In on example, the bladder 16 includes one or more flanges or tabs spaced around its periphery, and the flanges or tabs are attached to the bottom surface 14 to secure the bladder 16 in place. In another example, the bladder 16 may include a heat-sealed peripheral flange to enable attachment of the bladder 16 to the bottom surface 14 using fasteners, adhesives, stitching, or any other suitable mechanism for attaching the bladder 16 to the bottom surface 14. In yet another embodiment, a fabric portion of the insulating layer of the bladder 16 may be sewn or otherwise attached to the bottom surface 14.

The exterior of the pillow 10 formed by the top surface 12 and bottom surface 14 may be made from any suitable fabric, including polyester, cotton, or the like. In one embodiment, the top surface 12 and bottom surface 14 are a single piece of fabric and the envelope is formed by folding the fabric in half and stitching two sides together.

The bladder 16 may be formed using any suitable fluid-impenetrable material, such as plastic or rubber. As described above, the bladder 16 may also have a surrounding insulting layer formed from any suitable insulating or cushioning material.

In use, the pillow 10 is filled with compressible fill 20, which is inserted into the envelope formed by the top surface 12 and bottom surface 14 above the bladder 16. That is, the compressible fill 20 is inserted in an open space 18 formed between an upper surface 24 of the bladder 16 and the top surface 12. The compressible fill 20 may include natural materials, such as goose or duck down or even cotton, or synthetic fill. In another embodiment, the pillow 10 may be used as a cover for a conventional pillow. That is, the pillow 10 may be used as a pillow case or pillow slip, meaning the conventional pillow is inserted into the open space 18 between the upper surface 24 and the top surface 12. The upper surface 24 of the bladder 16 may, in some embodiments, be the insulating layer.

In accordance with one aspect of the present application, the pillow 10 further includes an elongate neck support mat 40. The elongate neck support mat 40 is a generally-flat semi-rigid material extending substantially from one short edge 32 to the short edge 32 within the envelope of the pillow 10. Elongate neck support mat 40 is disposed proximate a long side 36 of the bladder 16, which corresponds to the long edge 34 of the bottom surface 14. The elongate neck support mat 40 is located atop the upper surface 24 of the bladder 16.

In the embodiment shown in FIG. 2, the elongate neck support mat 40 is maintained in position proximate the long side 36 and atop the upper surface 24 by way of a pocket 42 formed atop the upper surface 24. The pocket 42 may be formed from fabric or formed as an integral part of the upper surface 24 of the bladder 16. For example, a pocket of fabric may be formed using material similar to that used to form the top surface 12 and bottom surface 12. The pocket 42 may be stitched to the interior long edge 36 of the top surface 12. The pocket 42 may be attached to the upper surface 24 of the bladder 16, such as by adhesives or other mechanisms. In the case of an integrally-formed pocket 42, the bladder 16 itself may feature straps, loops, or other elements designed to hold the elongate neck support mat 40 in place. If the bladder 16 includes the insulating layer, the pocket 42 may be formed as part of the insulating layer or may be sewn into or otherwise attached to the insulating layer. Other mechanisms for maintaining the elongate neck support mat 40 in place on top of the upper surface 24 are also contemplated and intended to be included herein.

As will be further discussed below, the elongate neck support mat 40 may be formed from a single strip or slat of material. The strip or slat is substantially flat and extends for substantially the length of the long side 36 of the bladder 16.

In other embodiments, as will be described below, the elongate neck support mat 40 is formed from a plurality of slats or strips of material. The plurality of slats are connected side-by-side to form the elongate neck support mat 40 using a suitable webbing material. The webbing material permits the mat 40 to curve or bend in the transverse direction; that is, the mat 40 is able to mold to curvature in the transverse direction due because the slats or strips are flexibility connected to each other along their length. The rigidity of the slats themselves prevents or lessens the ability of the elongate neck support mat 40 to curve or bend along its longitudinal direction. It will be appreciated that the strips or slats, if made of a semi-rigid material, may flex or bend to some degree in a direction normal to their flat surface. However, when the elongate neck support mat 40 molds to a transverse curve, then the strips or slats that form the elongate neck support mat 40 are less able to flex along their length due to their connection to other strips or slats that are not lying in the same plane because of the curvature.

Figure 3:
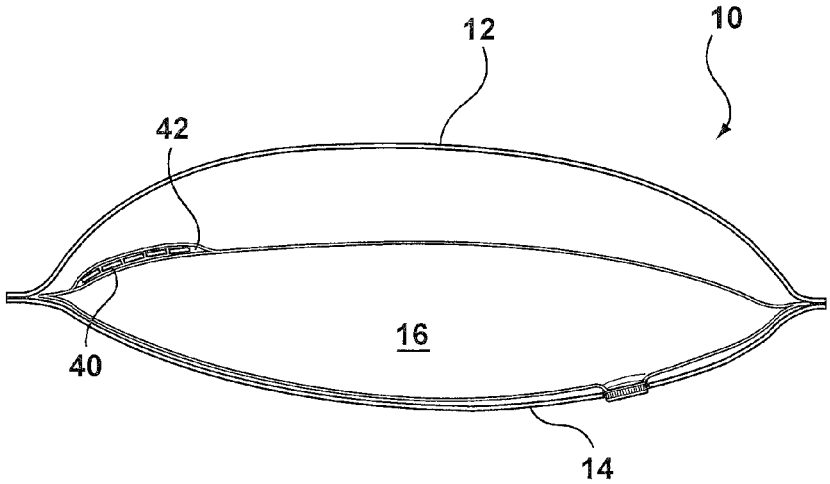
FIG. 3 shows a cross-sectional end view of the example pillow, in use.
Figure 4:
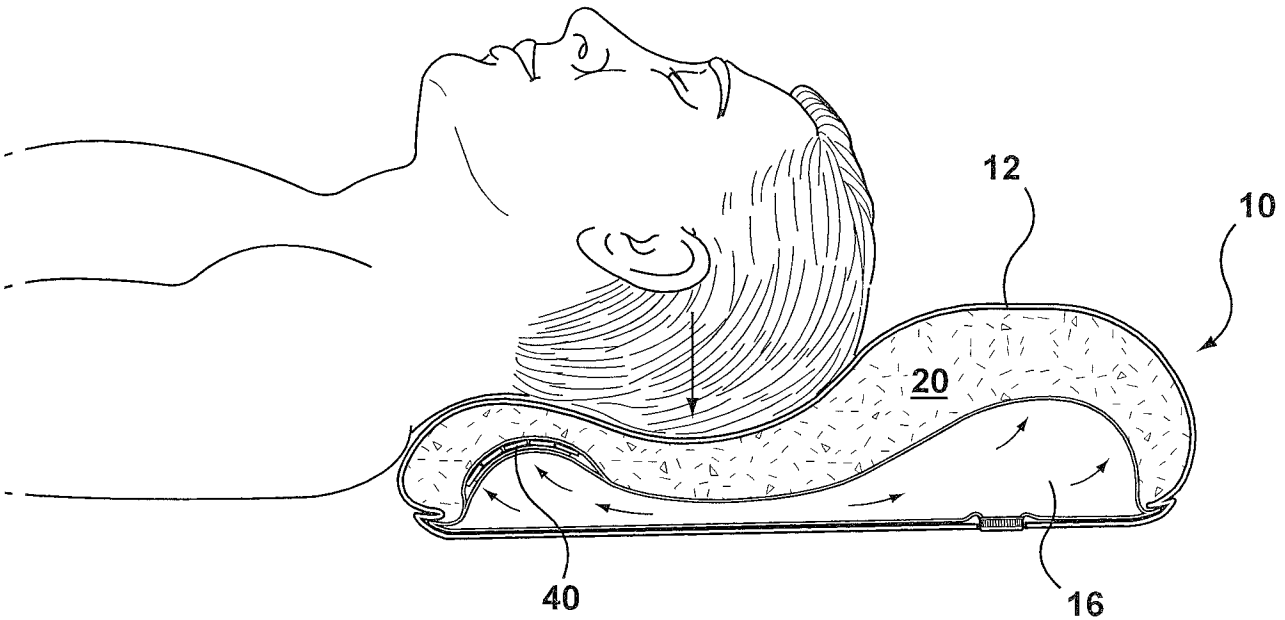
FIG. 4 shows a cross-sectional end view of the example pillow when deformed, in use.

Reference will now be made to FIGS. 3 and 4. FIG. 3 shows a cross-sectional view of an example of the pillow 10, in use, with the bladder 16 filled with a fluid, such as water. FIG. 4 shows a cross-sectional view of the same pillow 10, in use, under the compressive force of the head of a user.

The downward vertical force in the central region of the pillow 10 displaces the water within the central portion of the bladder 16. As indicated by the force lines in FIG. 4, the water is displaced toward the edges of the bladder 16, including towards the long side 36 proximate the elongate neck support mat 40. This tends to cause an upward force on the elongate neck support mat 40 along its entire length, which helps to counteract the downward force exerted by the user's neck near the central portion of the elongate neck support mat 40. In this manner, the elongate neck support mat 40 better counteracts the downwards compressive force of the user's neck by leveraging the small upward forces across the entire portion of the bladder 16 covered by the elongate neck support mat 40. That is to say, the water displacement caused by the weight of the head and neck partly, and proportionally, displaces water to the portion of the bladder 16 under the respective ends of the elongate neck support mat 40. This upwards force on the ends (and entire undersurface) of the elongate neck support mat 40 assists in counteracting the localized downward pressure exerted by the user's neck, thereby providing support to the user's neck.

Figure 5:
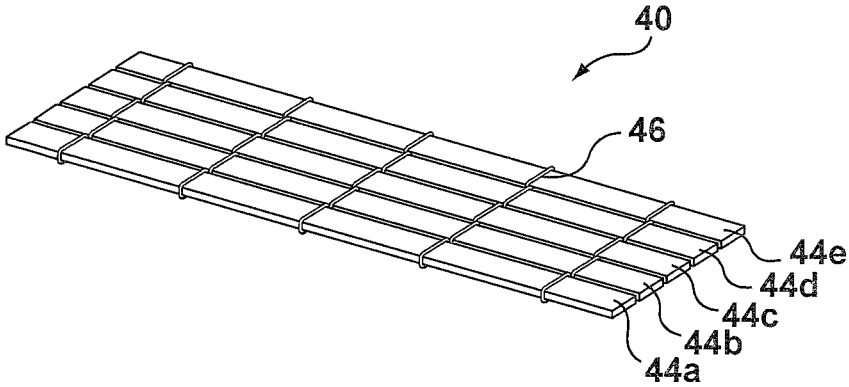
FIG. 5 shows a perspective view of one example embodiment of an elongate neck support mat.
Figure 6:
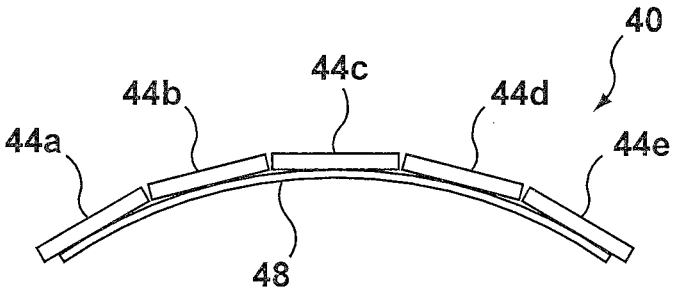
FIG. 6 shows an end view of the example elongate neck support mat.

Reference is now made to FIGS. 5 and 6. FIG. 5 shows a perspective view of one example embodiment of the elongate neck support mat 40. FIG. 6 shows an end view of the example elongate neck support mat 40 when molded to a transverse curve.

In this example, the elongate neck support mat 40 includes a plurality of slats 44 (shown individually as 44*a*, 44*b*, 44*c*, 44*d*, and 44*e*), connected side-by-side by webbing. In this example, the webbing is provided through strings 46 tying the individual slats 44 side-by-side. Alternatively, or in addition, the webbing may be provided by a fabric backing on one or both sides of the mat 40. The fabric backing may be adhesively attached to the slats 44 in some example implementations. In some cases, the slats 44 may be connected by strips of fabric backing running across the slats 44 and spaced along their length. In some cases, the fabric backing may by attached along both sides of the ends of the slats 44 so as to form a protective pocket in which the ends of the slats 44 are contained. Other methods and materials for providing a webbing attaching the slats 44 side-by-side, but permitting them to pivot relative to each other are intended to be included herein.

The slats 44 may be formed from any substantially rigid material, including plastic or wood. In some cases, the slats 44 may be formed using bamboo.

In FIG. 6, instead of strings 46 (FIG. 5), the webbing is provided by a fabric backing 48 adhesively attached to the underside of the slats 44. As shown in FIG. 6, the webbing (in this case, the fabric backing 48) permits the slats 44 to pivot relative to each other to at least some degree, so as to enable the mat 40 to mold to a transverse curve. It will be appreciated that even if the slats 44 are semi-rigid and able to flex along their length in a direction normal to their flat surface, that when the mat 40 is curved the slats 44 cannot flex in that manner because at least some of the slats 44 are angled relative to the direction of flex. Accordingly, in such embodiments, when the mat 40 is molds to a transverse curve it become more rigid and inflexible along its length.

Figure 7:
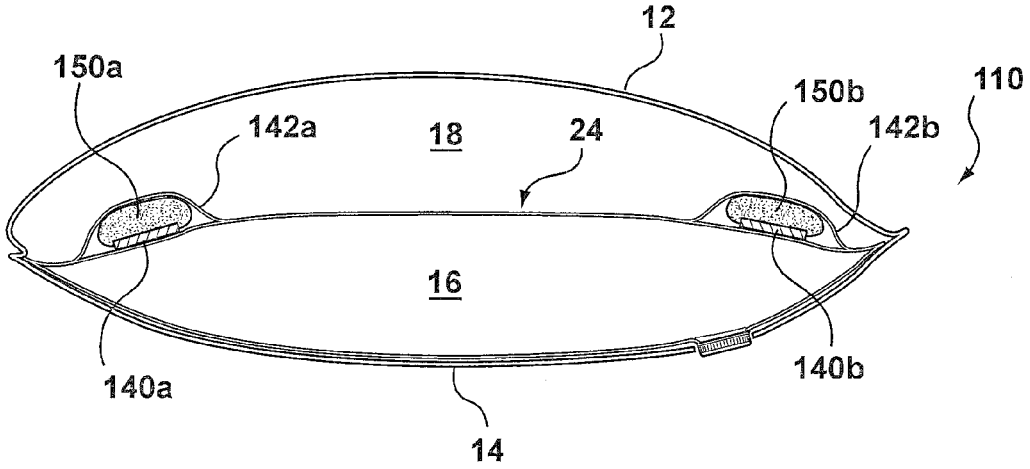
FIG. 7 shows a cross-sectional end view of another example pillow.

Reference is now made to FIG. 7, which shows a cross-sectional view of another example embodiment of a pillow 110. The pillow 110 in this example includes the top surface 12 and bottom surface 14, and the bladder 16. The top surface 12 and upper surface 24 of the bladder 16 form the open space 18 into which a conventional pillow or compressible fill may be inserted.

In this example, the pillow 110 includes a first elongate neck support slat 140*a* and a second elongate neck support slat 140*b*, positioned on opposite sides of the upper surface 24. Each elongate neck support slat 140 includes a relatively flat long rigid strip of material, such as bamboo, plastic, or other materials. In some embodiments, the material is selected on the basis that it is relatively strong, lightweight, and at least somewhat resistant to bacteria and mold.

In another embodiment, the neck support slats 140 may each be replaced with an elongate neck support mat, such as the mat 40 depicted in FIG. 5.

Each of the elongate neck support slats 140 in this example include a cushion 150 (shown individually as 150*a*, 150*b*) covering at least the top portion of the slat 140. The cushion 150 is a semi-rigid deformable material intended to provide additional comfort to the user if the compressible fill is relatively thinly disbursed over top of the slat 140. The cushion 150 is typically softer than the slat 140 but more rigid than the compressible fill. Suitable material for the cushion includes manufactured foam, such as polyurethane, for example.

In some embodiments, the cushion 150 has a track or groove in its underside into which the slat 140 is press fit to secure it in place. In some other embodiments, the cushion 150 has a central aperture into which the slat 140 is inserted, such that the cushion 150 surrounds the slat 140.

The slat 140 and cushion 150 are held in place by a pocket 142 (shown individually as 142*a* and 142*b*) in this embodiment. In another embodiment, the slat 140 and/or cushion 150 may be otherwise secured in place atop the bladder 16. For example, the cushion 150 may be adhesively attached to the upper surface 24 of the bladder 16.

Figure 8:
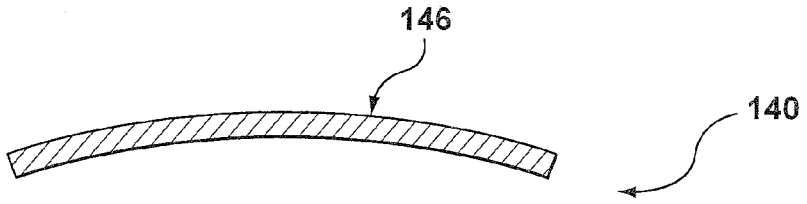
FIG. 8 shows an end view of an example slat.

Reference is now made to FIG. 8, which shows an end view of the elongate neck support slat 140. In this example embodiment, the slat 140 is relatively thin and flat along its upper surface 146, but features a slight convexity.

Figure 9:
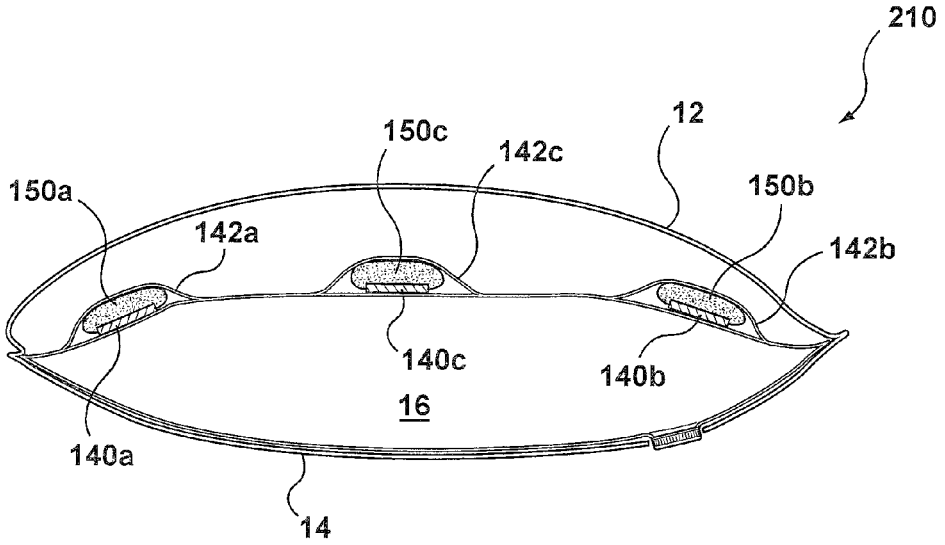
FIG. 9 shows a cross-sectional end view of a further example embodiment of the pillow.
Figure 10:
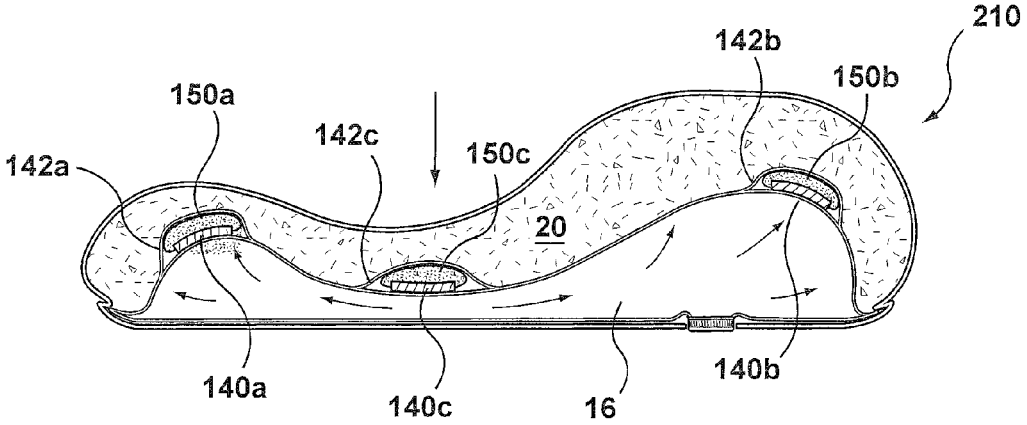
FIG. 10 shows the further example embodiment of the pillow when deformed, in use.

Reference will now be made to FIGS. 9 and 10. FIG. 9 shows a cross-sectional view of a three-slat embodiment of a pillow 210. FIG. 10 shows the same view of the pillow 210 when in use and under deforming pressure.

The pillow 210 includes a third elongate support slat 140*c* and corresponding cushion 150*c* and pocket 142*c*. The third elongate support slat 140 is not for neck support. Rather, it is depressed by the user's head when the user's head exerts downward pressure on the central portion of the pillow 210. The third elongate support slat 140*c* transfers that downward pressure to the sides of the bladder 16, thereby exacerbating the water displacement from the sides of the bladder 16, and increasing the water displacement into the other portions of the bladder 16 including under the elongate neck support 140*a*. This may improve the extent to which the water displacement and consequent upward pressure on the elongate neck support 140*a* acts to support the user's neck.

In the foregoing description, the slats or strips are described as being rigid or substantially rigid in some embodiments. The slats or strips are intended to be selected on the basis that they are at least semi-rigid. Semi-rigid materials will permit flexing along their longitudinal lengths normal to their flat surface. Rigid materials will not flex when in use in the manner contemplated wherein. Rigid materials are intended to be included in the term semi-rigid for the purpose of the present application. In some cases, the slats or strips are selected on the basis that they are formed from rigid materials. In some embodiments in which an elongate neck support mat is formed from semi-rigid slats arranged side-by-side, the slats may be formed from a semi-rigid material and may flex relatively easily individually; however, when assembled into a mat, the mat flexes along the longitudinal length less easily, particularly when the mat assumes a transverse curvature.

Certain adaptations and modifications of the described embodiments can be made. Therefore, the above discussed embodiments are considered to be illustrative and not restrictive.

What is claimed is:

1. A pillow, comprising:

a top surface and a bottom surface forming an envelope, the top and bottom surfaces having a long edge and two short edges;

a fluid-impermeable bladder within the envelope and attached to the bottom surface, the bladder having an upper surface, the upper surface and top surface defining an open space for containing compressible fill inserted in the envelope, and wherein the bladder has a long side corresponding to the long edge of the bottom surface; and an elongate neck support mat atop the upper surface of the bladder proximate the long side of the bladder and extending parallel with the long edge in a longitudinal direction, wherein the elongate neck support mat comprises a plurality of semi-rigid slats side-by-side and interconnected by a webbing material, wherein the elongate neck support mat, in use, adopts a transverse curve to mold to a user's neck contour and is inflexible along the longitudinal direction when transversely curved.

2. The pillow of claim 1, wherein the slat further comprises a foam cushion atop the thin long strip of semi-rigid material.

3. The pillow of claim 1, wherein the webbing material is a fabric backing.

4. The pillow of claim 1, wherein the webbing material is string.

5. The pillow of claim 1, wherein the slats comprise bamboo strips.

6. The pillow of claim 1, wherein the pillow cover further comprises a foam cushion atop the elongate neck support mat.

7. The pillow of claim 1, further comprising a second elongate neck support mat attached to the upper surface of the bladder proximate an opposite long side of the bladder and extending parallel to the opposite long side.

8. The pillow of claim 1, further comprising a central elongate support mat attached to the upper surface of the bladder proximate the middle of the upper surface and extending longitudinally.

9. The pillow of claim 1, further comprising a pocket for maintaining the elongate neck support mat in place atop the upper surface.

10. The pillow of claim 1, wherein the elongate neck support mat is attached to the upper surface.

11. The pillow of claim 1, further comprising compressible fill within the envelope and above the elongate support mat and the upper surface.

12. The pillow of claim 1, further comprising a conventional pillow within the envelope and above the elongate support mat and the upper surface.

13. The pillow of claim 1, further comprising a second elongate neck support mat attached to the upper surface of the bladder proximate an opposite long side of the bladder and extending parallel to the opposite long side, and a central elongate support mat attached to the upper surface of the bladder proximate the middle of the upper surface and extending longitudinally.

* * * * *

UNITED STATES PATENT AND TRADEMARK OFFICE

CERTIFICATE OF CORRECTION

PATENT NO. : 8,719,981 B2
APPLICATION NO. : 13/455666
DATED : May 13, 2014
INVENTOR(S) : John Jaskot It is certified that error appears in the above-identified patent and that said Letters Patent is hereby corrected as shown below:

On the Title Page
Item (57) Abstract:
Column 2, lines 4 and 5: replace “along the substantially” with --substantially along--.

In the Specification
Description of Example Embodiments
Column 2, line 13: replace “References” with --Reference is--.
Column 2, line 15: replace “cross sectional” with --cross-sectional--.
Column 2, line 39: replace “insulting” with --insulating--.
Column 2, line 49: replace “on” with --one--.
Column 2, line 65: replace “stitching two” with --stitching the two--.

Column 3, line 1: replace “insulting” with --insulating--.
Column 3, line 35: replace “bottom surface 12” with --bottom surface 14--.
Column 3, line 59: replace “direction due because” with --direction because--.
Column 3, line 59: replace “flexibility” with --flexibly--.

Column 4, line 66: replace “molds” with --molded--.
Column 4, line 67: replace “become” with --becomes--.

Column 5, line 66: replace “wherein” with --herein--.

Signed and Sealed this
Fifth Day of August, 2014

Michelle K. Lee

Michelle K. Lee
*Deputy Director of the United States Patent and Trademark Office*